US006185796B1

(12) United States Patent
Ausnit

(10) Patent No.: US 6,185,796 B1
(45) Date of Patent: Feb. 13, 2001

(54) VACUUM SEAL RECLOSABLE ZIPPER

(75) Inventor: Steve Ausnit, New York, NY (US)

(73) Assignee: Illinois Tool Works Inc., Glenview, IL (US)

( * ) Notice: Under 35 U.S.C. 154(b), the term of this patent shall be extended for 0 days.

(21) Appl. No.: 09/378,275

(22) Filed: Aug. 20, 1999

(51) Int. Cl.[7] ..... B65D 33/25
(52) U.S. Cl. ..... 24/587
(58) Field of Search ..... 24/30.5 R, 587, 24/575, 576; 383/63, 68

(56) References Cited

U.S. PATENT DOCUMENTS 3,172,443 * 3/1965 Ausnit .
4,430,070 * 2/1984 Ausnit .
4,578,813 * 3/1986 Ausnit .
4,791,710 * 12/1988 Nocek et al. .
4,863,286 * 9/1989 Branson .
4,878,763 * 11/1989 Ausnit .
5,017,021 * 5/1991 Simonsen et al. .
5,272,794 * 12/1993 Hamatani et al. .
6,033,113 * 3/2000 Anderson .

* cited by examiner

*Primary Examiner*—James R. Brittain
(74) *Attorney, Agent, or Firm*—Pitney, Hardin, Kipp & Szuch LLP

(57) ABSTRACT

A reclosable zipper having a first profile interlockable with a second profile is provided. The profiles include interlocking members which engage to form a vacuum seal when the profiles are interlocked. To provide resistance to product side separation forces, one of the profiles is additionally provided with an asymmetrical arrow-shaped member which interlocks with a groove element on the other profile so as to make it more difficult to open the zipper from the product side than the consumer side. To provide further resistance to product side separation forces, a hinge member may optionally be provided on one of the profiles.

3 Claims, 1 Drawing Sheet

VACUUM SEAL RECLOSABLE ZIPPER

BACKGROUND OF THE INVENTION

1. Field of the Invention

The present invention relates to the field of reclosable packaging. More particularly, the present invention relates to a new type of reclosable zipper for use in the manufacture of reclosable packages.

2. Description of the Prior Art

Reclosable zippers comprised of interlocking profiles are extremely well-known in the reclosable packaging art. Nonetheless, because of the ever increasing uses for reclosable packaging, including pre-packaged consumer food products, reclosable zippers remain highly susceptible to improvement.

One particular area which remains susceptible to improvement is the ability to achieve a satisfactory vacuum seal through use of a reclosable zipper. The ability to achieve such a vacuum seal is of particular importance when reclosable packages are used to store perishable food products. In the absence of a satisfactory vacuum seal, stored food products tend to prematurely lose their freshness and spoil. Vacuum packaging may also be required for the proper storage and protection of other oxygen sensitive items such as certain electronic components and military hardware. In addition, the ability for a package to support a vacuum also permits the bulk of the package to be reduced by drawing out excess air which has storage and shipping advantages.

While there are numerous prior art reclosable zippers which provide such a vacuum seal, these zippers have proven unsatisfactory in that such reclosable zippers do not provide satisfactory resistance to the opening of the zipper by forces that act to open the zipper from the inside of the package (so-called product side separation forces).

Accordingly, it is the object of the present invention to provide a new type of reclosable zipper which provides a satisfactory vacuum seal and which provides satisfactory resistance to product side separation forces.

SUMMARY OF THE INVENTION

In accordance with one embodiment of the present invention, a reclosable zipper having a first profile interlockable with a second profile is provided. The profiles include complementary interlocking members which engage to form a vacuum seal when the profiles are interlocked. To provide resistance to product side separation forces, one of the profiles is additionally provided with an asymmetrical arrow-shaped member which interlocks with a groove element on the other profile. The asymmetrical arrow-shaped member is oriented so that it is more difficult to disengage the profiles from the product side.

In accordance with another embodiment of the present invention, a reclosable zipper having a first profile interlockable with a second profile is provided. The profiles include complementary interlocking members which engage to form a vacuum seal when the profiles are interlocked. To provide resistance to product side separation forces, a hinge member is provided on one of the profiles.

The present invention will now be described in detail, with frequent reference being made to the drawings identified below in which identical numerals represent identical elements.

DETAILED DESCRIPTION OF THE PREFERRED EMBODIMENT

Figure 1:
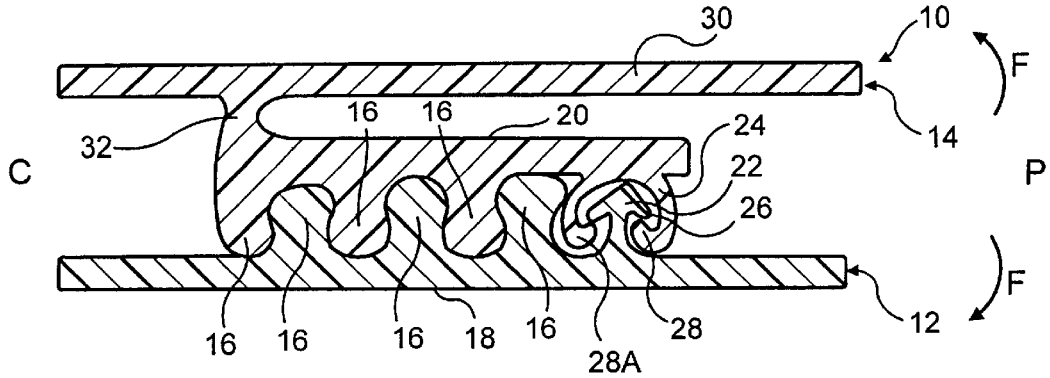
FIG. 1 is a cross-sectional view of a reclosable zipper in accordance with a first embodiment of the present invention.

In accordance with a first embodiment of the present invention, a cross-sectional view of a length of reclosable zipper 10 formed from any one of many commonly known resilient plastics is shown in FIG. 1.

The zipper 10 is formed of a resilient plastic and has a first profile 12 interlockable with a second profile 14. During use, the profiles 12, 14 are disposed across the mouth of a package, with each profile being attached to a package wall opposite to the wall to which the other profile is attached.

The profiles 12, 14 are each provided with complementary interlocking bulbous members 16 extending, respectively, from bases 18, 20 of the profiles towards the other profile. Because of their enlarged bulbous shapes, when these bulbous members 16 are interlocked with each other a tight interference fit is achieved between the profiles 12, 14, resulting in a vacuum seal.

However, the interlocked bulbous members 16 provide little or no resistance to disengagement of the profiles, from either the consumer side, i.e. the side of the profiles exposed to the package user, or the product side, i.e. the side of the profiles exposed to the package contents. For purpose of this discussion, the consumer side is denoted by the letter "C" and the product side is denoted by the letter "P" in the figures.

During package use, it is generally desirable that the zipper 10 be relatively easy to open from the consumer side C. On the other hand, it is not desirable that the zipper be easy to open from the product side P since the separation forces F imparted by the package contents could cause the package to inadvertently open and thereby cause the contents to lose their freshness and spoil. Additionally, opening of the zipper by the product side separation forces F during package transport could cause the package contents to spill from the package. Accordingly, it is desirable to construct the zipper so that it is highly resistant to product side separation forces F.

In order to provide this resistance, the first profile 12 of the zipper 10 is provided with an asymmetrical arrow-shaped member 22 which is interlockable with a groove element 24 on the second profile 14. As is clear from FIG. 1, the head of the arrow-shaped member 22 is asymmetrically shaped such that an extended portion 26 of the arrow head engages with a hooked portion 28 of the groove element 24 when the profiles are pulled apart from the product side P by the product side separation forces F, thus providing resistance to the disengagement of the profiles. On the other hand, when the profiles are pulled apart from the consumer side C, the engagement of the arrow-shaped member 22 and the groove element is reduced due to the smaller extended portion 28A, making it much easier to disengage the profiles.

Optionally, to provide further resistance to the product side separation forces F, one of the profiles may be provided with a hinge member. In FIG. 1, the second profile 14 is provided with a hinge member 30 which is attached to the base 20 of the second profile on the consumer side C of the zipper 10 by a pivot member 32. During use, the first profile base 18 and the hinge member 30 are attached to opposite package walls. When product side separation forces F push apart the package walls (indicated by the arrows), the hinge member 30 rotates about the pivot member 32, thereby absorbing most of the product side separation forces.

Figure 2:
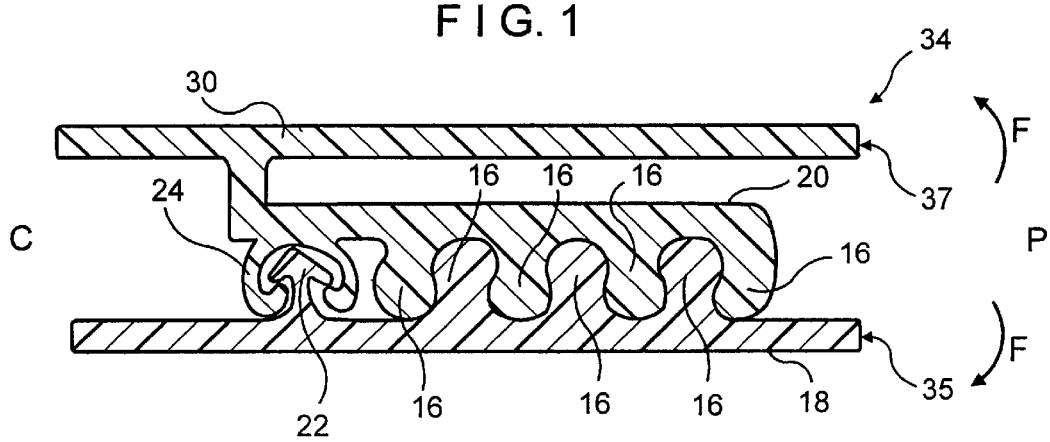
FIG. 2 is a cross-sectional view of a reclosable zipper in accordance with a second embodiment of the present invention.

FIG. 2 shows a cross-sectional view of a length of reclosable zipper 34 in accordance with an alternate embodiment of the present invention. The reclosable zipper 34 includes first and second profiles 35, 37 and is nearly identical to the reclosable zipper 10 of FIG. 1, except that the asymmetrical arrow-shaped member 22 and groove element 24 are on the consumer side C, rather than the product side P.

Figure 3:
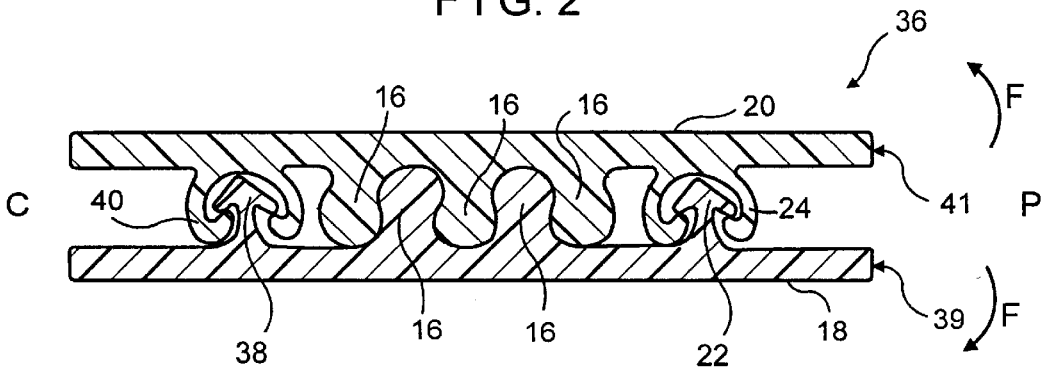
FIG. 3 is a cross-sectional view of a reclosable zipper in accordance with a third embodiment of the present invention.

FIG. 3 show a cross-sectional view of a length of reclosable zipper 36 in accordance with yet another alternate embodiment of the present invention. Comparing FIG. 3 and FIG. 1, the reclosable zipper includes first and second profiles 39, 41 and is provided with a second asymmetrical arrow-shaped member 38 and a second groove element 40 to provide additional resistance to the product side separation forces F. Because of this additional resistance, a hinge member is not provided, although the zipper 36 could be modified to include a hinge member if further resistance is desired.

Figure 4:
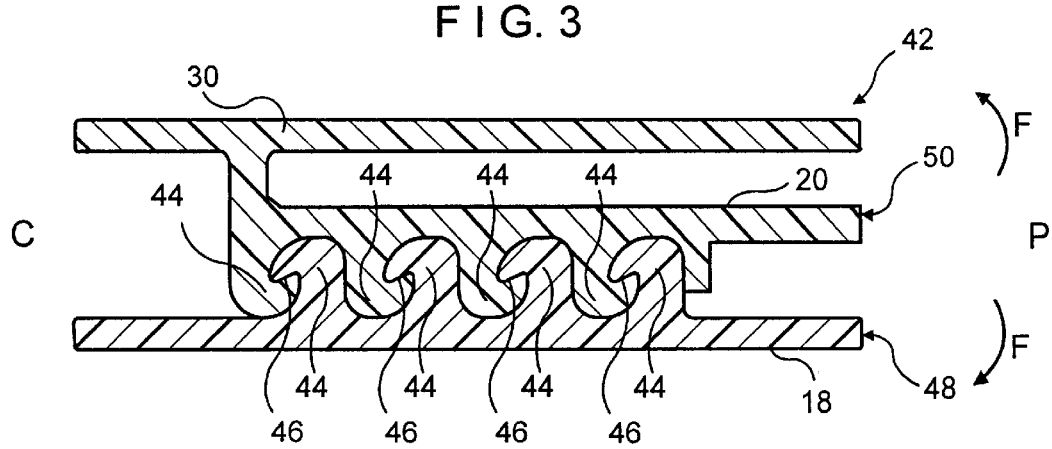
FIG. 4 is a cross-sectional view of a reclosable zipper in accordance with a fourth embodiment of the present invention.

FIG. 4 shows a cross-sectional view of a length of reclosable zipper 42 in accordance with yet another embodiment of the present invention. The zipper 42 includes first and second profiles 48 and 50. Rather than the bulbous members 16 of FIGS. 1–3, the reclosable zipper 42 of FIG. 4 employs thick interlocking hook members 44 which tightly interlock with groove 46 to achieve a vacuum seal. To provide the resistance needed to counteract the product side separation forces, the second profile 50 is provided with a hinge member 30.

Thus, in the foregoing maimer the object of the present invention is achieved. Modifications to the above would be obvious to those of ordinary skill in the art, but would not bring the invention so modified beyond the scope of the appended claims.

I claim:

1. A reclosable zipper comprising:

a first profile interlockable with a second profile, each of said profiles including at least one interlocking member extending from a base of the profile which engages with the interlocking member of the other profile, said interlocking members each including portions thereof which engage with each other in a tight interfering fit sufficient to form a vacuum seal therebetween;

one of said profiles further including an asymmetrical arrow-shaped member interlockable with a groove element on the other profile;

said asymmetrical arrow-shaped member and said groove element being configured so that when said arrow-shaped member and said groove element are interlocked, more force is required to disengage the interlocked profiles when pulling the profiles apart from one side of said reclosable zipper than when pulling the profiles apart from an opposite side of said reclosable zipper.

2. The reclosable zipper of claim 1 wherein said interlocking members' interfering fit portions are bulbous members which extend from the respective profile bases toward the opposite base.

3. The reclosable zipper of claim 1 further including a hinge member, said hinge member being attached to the base of one of said profiles via a pivot member on said consumer side.

* * * * *